US005103733A

United States Patent [19]

Drapatsky et al.

[11] Patent Number: 5,103,733

[45] Date of Patent: Apr. 14, 1992

[54] PRINTING MACHINE WITH CONTINUOUS SHEET FEED MECHANISM

[75] Inventors: Leonid Drapatsky, Wilmette; Wieslaw T. Chodorowski, Western Springs; Thomas P. Jachimek, Darien; Richard R. Jeschke, Niles, all of Ill.

[73] Assignee: A. B. Dick Company, Chicago, Ill.

[21] Appl. No.: 603,991

[22] Filed: Oct. 24, 1990

[51] Int. Cl.[5] ..... B41F 13/24

[52] U.S. Cl. ..... 101/485; 101/232; 101/240; 101/246; 271/108; 271/110; 271/176; 271/251; 271/82

[58] Field of Search ..... 101/142, 136, 217, 232, 101/246, 240, 483, 485; 271/5, 82, 90, 94, 96, 98, 108, 110-112, 176, 251

[56] References Cited

U.S. PATENT DOCUMENTS

| | | | |
|---|---|---|---|
| 3,469,526 | 9/1969 | Gallagher | 101/142 |
| 3,913,478 | 10/1975 | Terzvold et al. | 101/232 |
| 3,916,790 | 11/1975 | Alix | 101/232 |
| 3,947,016 | 3/1976 | Horung et al. | 271/96 |
| 3,955,494 | 5/1976 | Suzuki | 101/232 |
| 4,451,029 | 5/1984 | Wildmann et al. | 271/108 |
| 4,513,957 | 4/1985 | Schaefer Jr. | 271/90 |
| 4,771,691 | 9/1988 | Sakurai et al. | 101/246 |
| 4,960,049 | 10/1990 | Mimura et al. | 101/217 |
| 4,978,113 | 12/1990 | McAuley et al. | 271/111 |

FOREIGN PATENT DOCUMENTS

| | | | |
|---|---|---|---|
| 2600773 | 7/1977 | Fed. Rep. of Germany | 271/94 |
| 2501111 | 9/1982 | France | 101/136 |
| 0254435 | 11/1986 | Japan | 271/5 |

*Primary Examiner*—Eugene H. Eickholt
*Attorney, Agent, or Firm*—Jones, Day, Reavis & Pogue

[57] ABSTRACT

An improved printing machine for moving paper sheets from a paper stack along an endless belt to an impression cylinder with continual movement of the paper sheet without stopping and starting. The instantaneous angular position of the impression cylinder is sensed and the instantaneous position of the paper along the endless belt is sensed and an error signal is generated if the relative positions are such that the paper will not arrive at the impression cylinder clamp at the proper time. The error signal causes the vacuum to be applied to a vacuum paper sheet pickup to be turned on and off at varying times to vary the time of pickup of each paper sheet that is deposited on the endless belt, thus controlling the position of each sheet on the belt. The invention allows large increases in printing speeds over the prior art because the sheets of paper are moved between the paper stack and the impression cylinder in a nonstop manner.

26 Claims, 8 Drawing Sheets

PRINTING MACHINE WITH CONTINUOUS SHEET FEED MECHANISM

FIELD OF THE INVENTION

The present invention relates in general to sheet-fed printing machines including presses/duplicators and in particular to an improved paper feeding and registering device for such printing machines in which once the paper is picked-up from the stack it moves continuously through the machine without stopping and starting. Also, the paper pick-up and transport is controlled to adjust the time and velocity thereof and thus the time of entry into the impression cylinder to cause the proper amount of paper buckle to allow high speed operation of the machine.

BACKGROUND OF THE INVENTION

Many printing machines accomplish lead edge register of paper sheets at the impression cylinder clamp or gripper by forcing the leading edge of the sheet into the stops of the open gripper and buckling it. This is accomplished by feed rollers which grip a sheet and accelerate it into the gripper. Lateral edge or side registration of the sheet is also desirable. Short-coupled sheet feed systems, ones exemplified by vacuum pick-up and delivery of sheets from the stack to forwarding rollers which accelerate the sheet lead edge into the impression cylinder grippers, either have minimal side registration between the impression cylinder and the pile or are completely without it. The prior art has attempted to overcome the sheet side registration deficiencies by interposing conveyor boards or transport tables between the sheet stack and the impression cylinder grippers. However, these have stopped the sheet to align it before advancing the lead edge thereof into the impression cylinder grippers.

All modern press/duplicator feeding devices with a conveyor board have head lay stops and side lay stops. The side guiding is done by means of push or pull guiding devices and the head lay or lead paper edge registration is done by two or more registration stops. This is known in the industry as three points registration. When handling paper at higher speed rates such as 5,000 I.P.H. (impressions per hour) and above, it has been noticed that the regular and heavy paper stocks sometimes bounce from the head lays two to four times before settling down. Only after that can the sheet of paper be pushed or pulled to the side for good side registration. The process of paper settling at the head lays takes a substantial amount of the printing cycle and after being side guided the paper sheet accelerates toward the grippers of the impression cylinder.

When handling light paper stocks the problem is even more difficult. The light-weight paper tends to create an accordion shape and creases when fed into the head lays at high printing speed. As a result, presses cannot feed light-weight papers at high speed and in order to be safe the printing speed is reduced. That, in turn, reduces the productivity of the press. Introduction of stream feed with a conveyor board improved the dynamics of the paper handling and registration because the speed of the paper on the conveyor board was reduced by the ratio 4/1 or 5/1. But even under these conditions, such light-weight paper sometimes buckles or creases as it contacts the front stops when the machine is operating at high printing speeds.

To solve the problem, a preferred embodiment of the present invention uses a transport table of a type customarily used to feed paper stock on a folding machine to transport the paper sheets from the paper stack to the feed rollers which transfer the sheets to the impression cylinder. The modifications made to the standard table achieve the synchronization of the operation of the sheet transport belt of the table and its sheet pickup (i.e., a vacuum suction device) with the operation of the offset duplicator feed rollers and the impression cylinder.

In a preferred embodiment of the present invention, the impression cylinder, the drive mechanism for the transport table and the vacuum device are all geared together to achieve the desired synchronization. Sensors note the instantaneous position of the impression cylinder and the instantaneous position of the paper sheets being carried by the transport belt. By utilizing a microprocessor to compare the instantaneous position of the paper on the transport board with the instantaneous rotated position of the impression cylinder, the computer can generate an error signal if the paper is not in a position at the speed at which it is traveling to arrive at the proper time in the gripper of the impression cylinder. This error signal is coupled to the vacuum device that is picking up the paper sheets from the paper stack and transferring them to the transport belt. By varying the time at which the suction is turned on, the time at which the paper is deposited on the transport belt may be delayed or advanced to change the instantaneous position of the paper on the transport belt with respect to the instantaneous rotary position of the impression cylinder gripper. Thus, accurate timing is achieved for the arrival of the paper at the gripper of the cylinder.

In an alternate embodiment of this invention, synchronization of timing of paper arrival at the cylinder gripper is achieved by varying the speed of the transport belt or the forwarding rollers in order to compensate for any mispositioning or buckling of the paper in the transport of the paper to the grippers.

Thus, in accordance with this improved and novel invention, paper is allowed to move continuously through the machine without stopping or starting and thus increases the output of the machine substantially over its present maximum capability.

Accordingly, it is an object of the present invention to provide a printing or duplicating machine in which the paper moves continuously from the paper stack to the impression cylinder without stopping or starting.

It is another object of the present invention to detect the instantaneous position of the paper on the transport belt with respect to the instantaneous rotated rotary position of the impression cylinder gripper so that it can be determined if the paper sheet is at the right position to be advanced into the gripper of the impression cylinder at the proper time.

It is also an object of the present invention to utilize a microprocessor to generate an error signal when the instantaneous position of a sheet of paper on the transport belt is incorrect with respect to the instantaneous rotary position of the impression cylinder gripper and to utilize the error signal to control the application of vacuum to the vacuum device which removes the individual paper sheets from the paper stack and transfers them to the transport belt, and thus vary the position of the paper on the transport belt such that the error signal is removed.

SUMMARY OF THE INVENTION

The present invention relates to sheet-fed, printing machines for printing indicia on paper sheets comprising a cylinder having a gripper for receiving the paper, a continuous belt for supplying paper sheets to the gripper of the cylinder, vacuum means for removing paper sheets from a stack and delivering the sheets to the continuous belt and means for continuously moving a sheet of paper between the stack and the impression cylinder without the need for stopping and starting the paper.

In this regard, the gripper may be positioned on various forms of cylinders. In a preferred embodiment, the cylinder is an impression cylinder. In another embodiment, the cylinder is a combined impression cylinder/-blanket cylinder as used on a perfector press. In a further embodiment, the gripper may be positioned on a transport cylinder which is positioned upstream of the impression cylinder or the combined impression cylinder/blanket cylinder.

The invention also relates to a method of duplicating indicia on individual paper sheets comprising the steps of receiving individual sheets in an impression cylinder gripper, the impression cylinder causing the indicia to be printed on the sheet of paper held in the gripper, removing the individual paper sheets from a stack of paper sheets and continuously maintaining movement of each paper sheet between the stack of paper sheets and the impression cylinder without stopping and starting, thereby increasing the number of sheets that can be printed in a given time.

The advancement of the paper sheets by continuous movement from the paper stack to the impression cylinder allows the speed of printing to be increased substantially, particularly for light weight papers such as onion skin and 7 to 9 pound paper stock.

BRIEF DESCRIPTION OF THE DRAWINGS

These and other objects of the present invention will be more clearly understood in conjunction with the accompanying drawings in which like numerals represent like elements and in which.

DETAILED DESCRIPTION OF THE DRAWINGS

Figure 1:
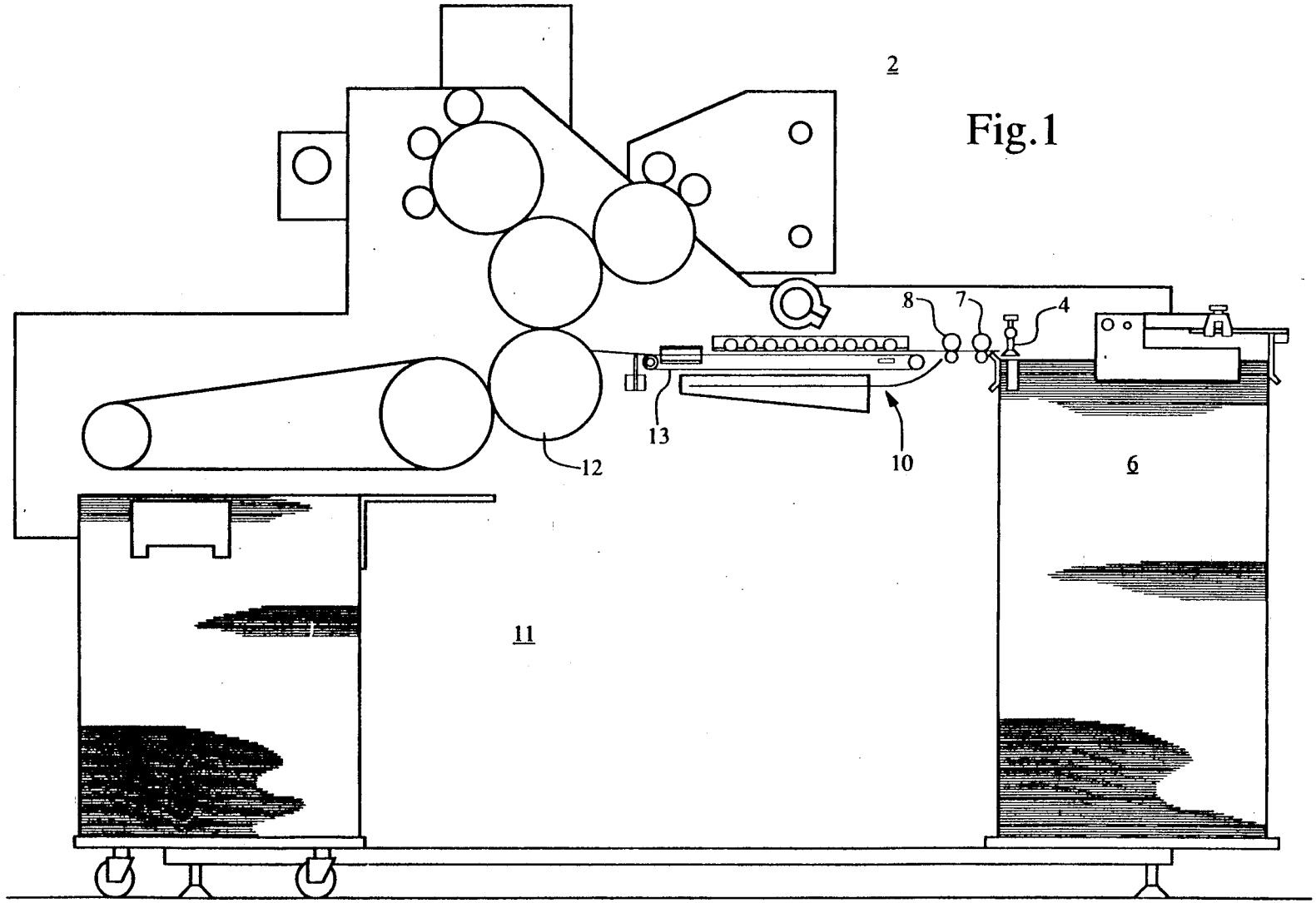
FIG. 1 is a side view of one embodiment of a printing machine in accordance with the present invention illustrating the concept and the relationship of a transport belt used to convey the individual paper sheets from the paper stack to the impression cylinder gripper.

FIG. 1 is a side view of a duplicator illustrating the conceptual relationship that is not intended to portray in detail the feed or transport table and the feed roller impression cylinder 12 interface, but is to illustrate the conceptual relationship between a transport table 10 (including a transport belt 13), the paper pick-up device 4 and the impression cylinder 12 that forms part of the duplicating machine 11. The paper feeder 4 removes the paper sheets sequentially from paper stack 6, feeds them through a double sheet detector 7 to the infeed rollers 8 onto the belt 13 of transport table 10. With the transport table 10 interposed between the paper feed mechanism 4 and the impression cylinder 12, the rotational speed of the impression cylinder 12, the speed of the endless belt 13 carried by the transport table 10 and the speed at which the paper feed mechanism 4 operates can all be synchronized as will be shown hereafter to enable the machine 11 to operate such that the paper moving from stack 6 to impression cylinder 12 does not have to stop and start anywhere in its path of movement, but moves continuously from the time that it is removed from paper stack 6 until it is printed.

Figure 2:
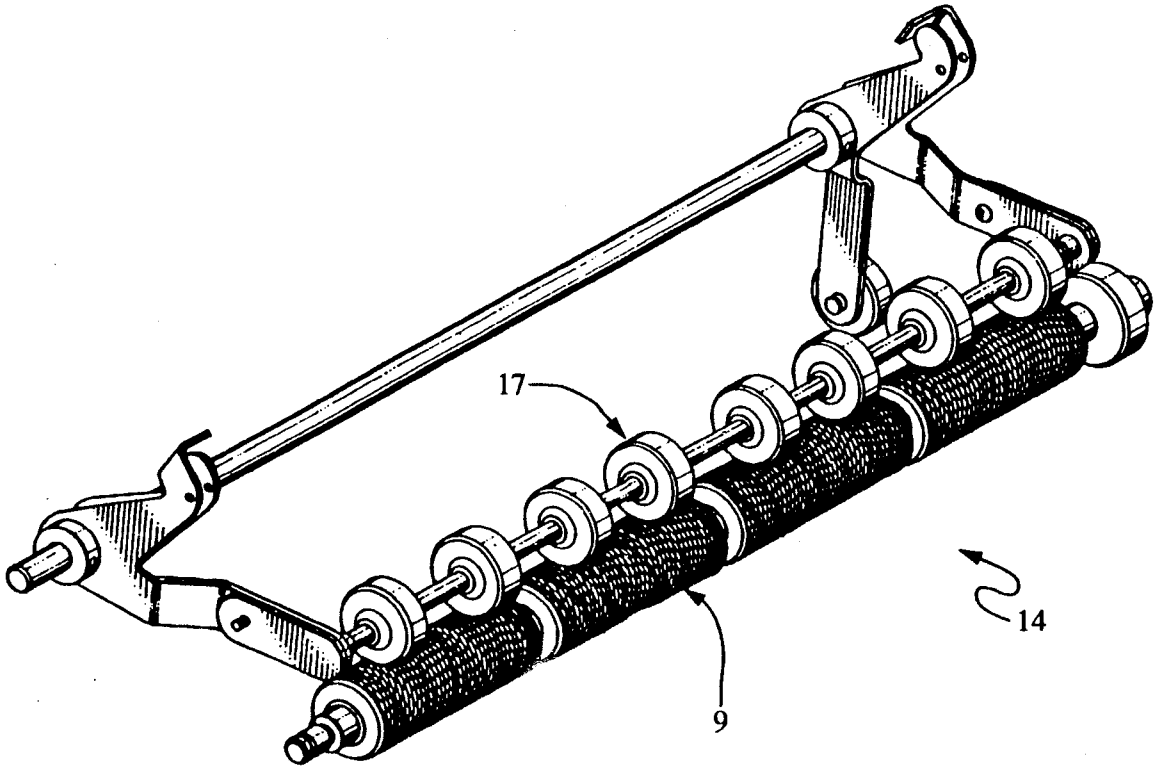
FIG. 2 is an isometric view of the feed rollers that carry the paper sheets from the transport table to the gripper of the impression cylinder gripper.
Figure 4:
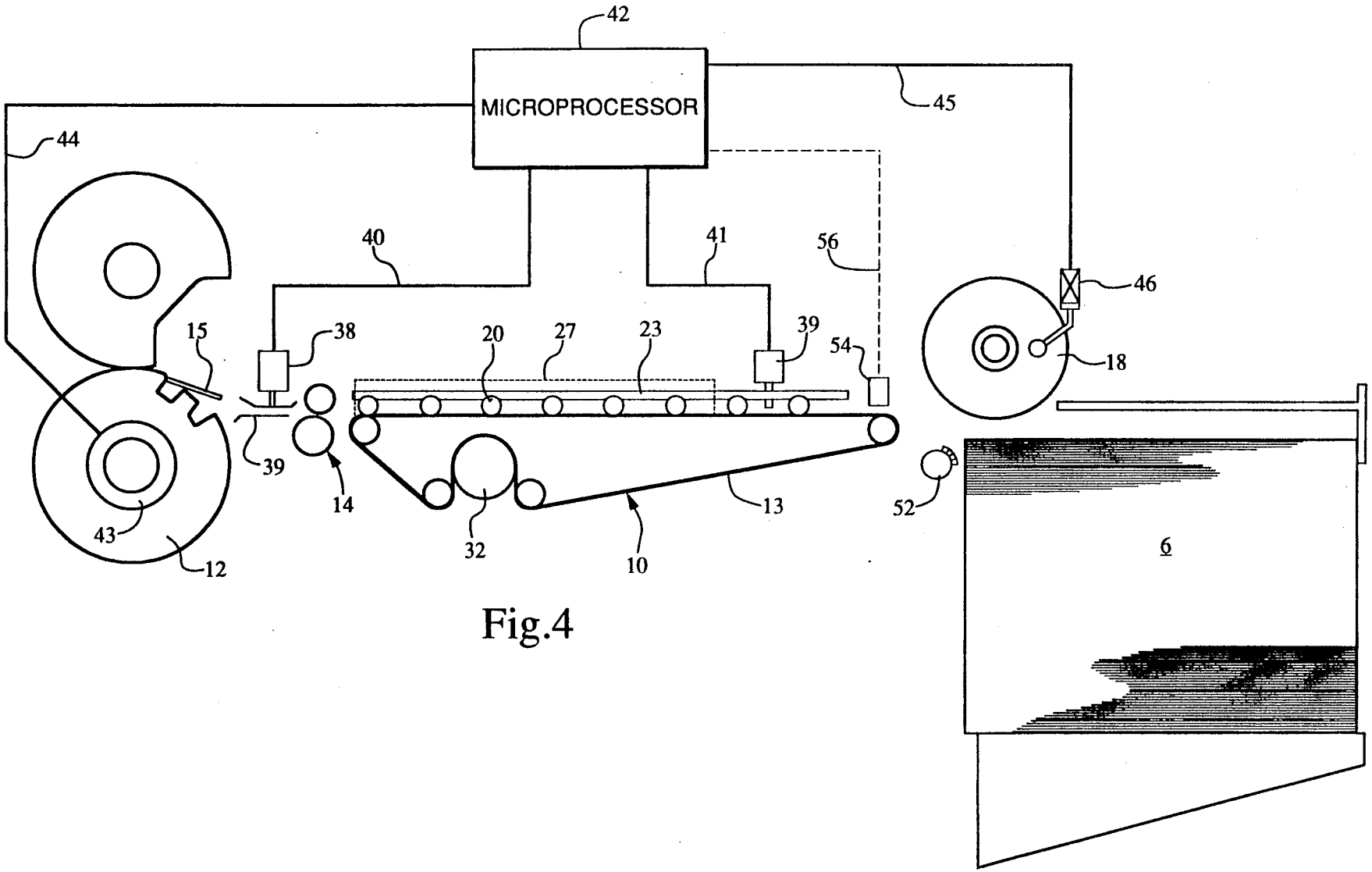
FIG. 4 is a conceptual side view of the printer illustrating the vacuum operated paper pickup, the transport table, the paper sensors, the impression cylinder and rotatable position sensor (encoder), the microprocessor for detecting the instantaneous rotatable position of the impression cylinder and the instantaneous linear position of the paper on the transport belt and generating an output signal to the vacuum solenoid valve for controlling the vacuum to adjust the time at which the paper is picked up by vacuum source and placed on the transport belt.
Figure 5:
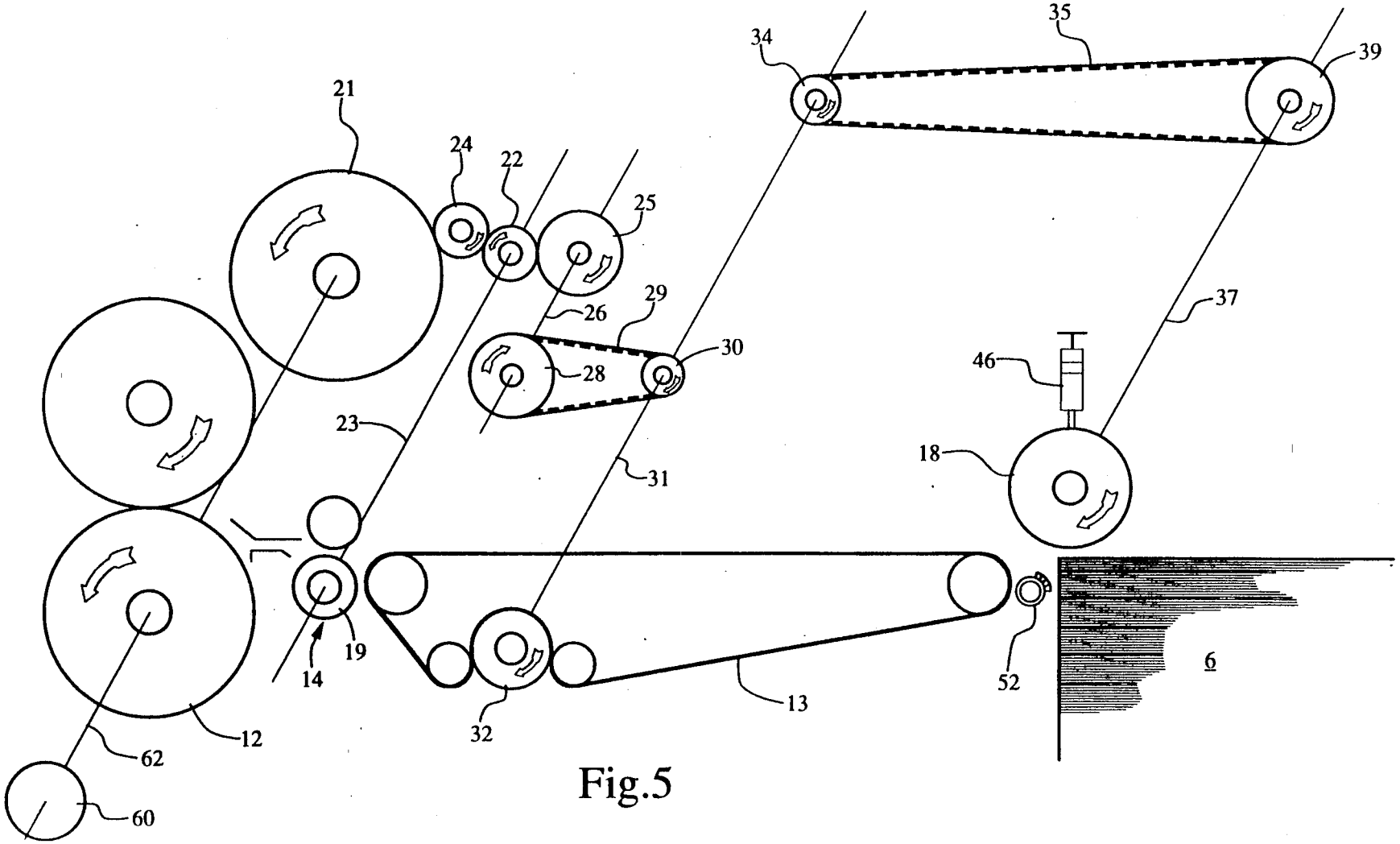
FIG. 5 is a drawing illustrating the timed relationship of the rotation of the impression cylinder, the transport table drive roller, and the vacuum wheel.

FIG. 2 illustrates the feed rollers 14 which feed the paper through a paper guide into the impression cylinder 12, but are not shown in the conceptual drawing of FIG. 1. They are illustrated in FIGS. 4 and 5. As can be seen in FIG. 2, the feed rollers 14 comprise a lower feed roller 9 and a set of upper feed rollers 17. As is well known in the art, feed rollers 14 forward the arriving paper sheet to the gripper of the impression cylinder with the proper buckle, then the upper feed rollers 17 lift to free the paper sheet. Thus there is no change in the operation of the feed rollers 14 from that illustrated in the prior art.

Figure 3A:
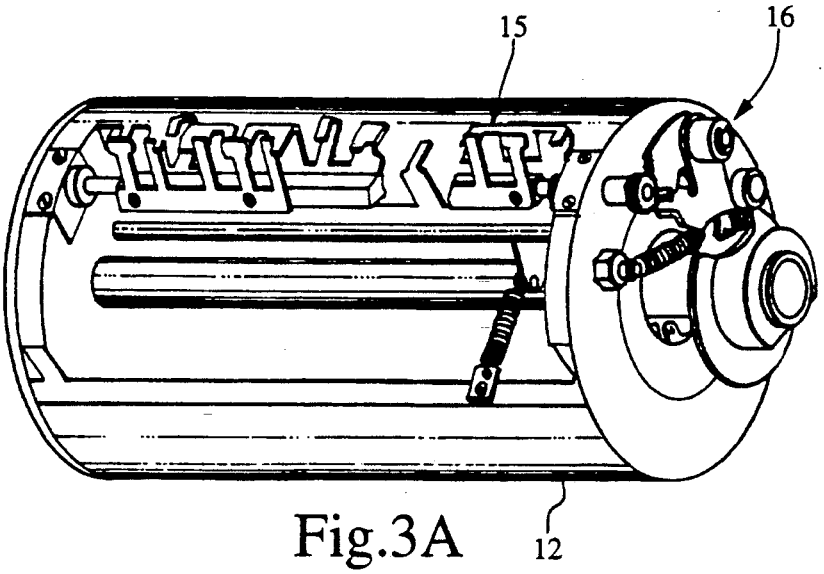
FIG. 3A is an isometric view of the impression cylinder illustrating the details of the paper clamp or gripper.
Figure 3B:
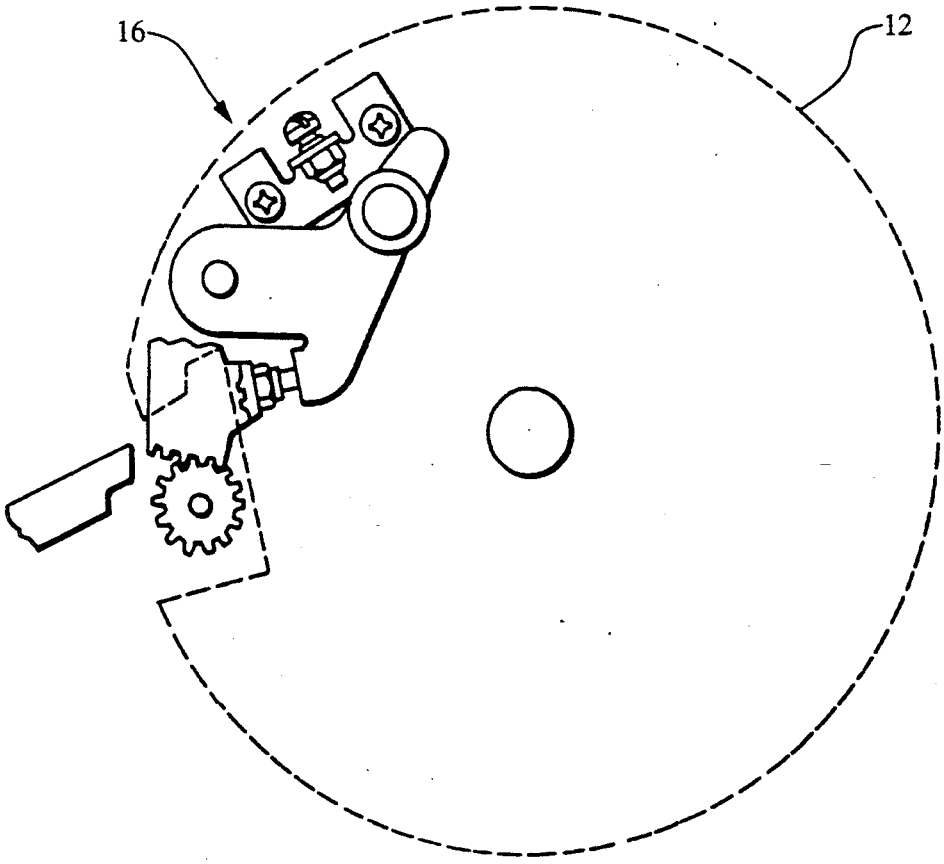
FIG. 3B is an end view of the impression cylinder illustrating the clamp or gripper of the impression cylinder.

FIG. 3A is an isometric view of the impression cylinder 12 illustrating driving mechanism 16 and the paper gripper 15 on the impression cylinder to which the feed rollers 14 of FIG. 2 deliver the leading edge of a paper sheet. The operation of the feed rollers 14 and the impression cylinder 12 with gripper 15 is well known in the art. FIG. 3B is an end view of the well known driving mechanism 16 for operating the paper grippers 15 of the impression cylinder 12 shown in isometric view in FIG. 3A.

FIG. 4 is a schematic elevation of the preferred embodiment of the present invention. Sheets from a stack of paper 6 are individually supplied by a vacuum source 18 to the transport table assembly 10. The vacuum source 18 may be a rotating suction drum as illustrated in FIG. 4 or, alternatively, may be a plurality of vacuum sucker feet as illustrated in FIG. 1. The transport table assembly 10 has a single biased transport belt 13 that runs under a series of balls 20 held by a guide 23 to transport the copy sheets to the feed rollers 14. A side guide 27, illustrated conceptually by dashed lines in FIG. 4, serves the important purpose of aligning the sheets of paper as the transport belt 13 drives them forward towards the feed rollers 14. Accordingly, at the time the sheet arrives at the nip of the feed rollers 14, it is completely aligned and ready to go into the feed rollers 14. The paper sensor 38 is located after the feed rollers 14 and before the impression cylinder 12, as for example, at paper guide 39, to sense the instantaneous position of the leading edge of a sheet of paper with respect to the instantaneous rotatable position of gripper 15 of the impression cylinder 12. The paper sensor 38 may be of any well-known type such as an optical sensor that produces a signal on line 40 that is coupled to a microprocessor 42. An optional paper sensor 39 may be mounted at the forward end of the transport table 10 if desired. In such case, again, the paper sensor 39 generates a signal on line 41 when the leading edge of the paper is detected. Again, the signal on line 41 would be coupled to microprocessor 42. The impression cylinder 12 has mounted on the rotating shaft thereof an encoder 43 that generates an electrical signal on line 44 that represents the instantaneous angular position of gripper 15 of impression cylinder 12 from a given reference point. The signals on lines 40 and 44 are coupled to microprocessor 42 which compares the position of the paper and the gripper 15 of the impression cylinder 12 and generates an output signal on line 45 that represents an error signal if the paper is not at the proper position such that as it is being feed at a known velocity toward the gripper 15 that it will not arrive at gripper 15 at the proper time to be properly held in the gripper 15 for printing. The error signal on line 45 is coupled to a vacuum solenoid valve 46 that controls the vacuum to the suction drum 18. Suction drum 18, as is well known, has a series of orifices therein in one area that move in close proximity to the sheets of paper in paper pile 6. When the solenoid valve 46 is opened so that a vacuum is applied to the suction drum 18, the top sheet of paper on stack 6 is lifted up towards the suction drum 18 and carried by drum 18 over to the transport table 10 and deposited on the drive tape or endless belt 13. If an error signal occurs on line 45, the solenoid valve 46 is opened earlier or later to cause to the sheet of paper to be picked up from pile 6 either earlier or later and deposited on endless belt 13, thus changing the instantaneous position of the paper on belt 13 so that it will arrive at the proper time at the gripper 15 of the impression cylinder 12.

The general operation of the device illustrated in FIG. 4 will now be described. Air blower 52 continuously provides an air blast to separate the top 6 to 8 sheets of paper on stack 6. This is accomplished by creating an air cushion by blower 52. Rotation of the suction drum 18 places the orifices in the predetermined area of the drum 18 in proximity to the top sheet of paper on stack or pile 6. Solenoid valve 46 is operated at the proper time to cause a vacuum in the suction drum 18 to pull the top sheet of paper to the drum 18 and carry it to the endless belt 13 on transport table 10. The vacuum is removed by closing of solenoid 46 and the paper is dropped onto the endless belt 13. A doubles sensor 54 may be used to sense if more than one sheet of paper is being picked up by the suction drum 18. If so, a signal is generated on line 56 to the microprocessor 42 that generates a return signal on line 45 to operate the vacuum solenoid valve 46 and stop the vacuum pick-up so as to stop the feeding of sheets.

The paper sheet on endless belt 13 passes under a series of hold-down balls 20. The hold-down balls 20 are mounted in a carrier 23 and are used for proper hold-down of the paper sheets. The ball carrier 23 is an elongated carrier that extends above the transport belt 13 aligned in the direction of movement of the belt 13 and toward the side guide 27. The paper is forced toward the side guide 27 by the skew of the belt 13 and, thus, is aligned against that side by the time it reaches the feed rollers 14, paper sensor 38 and the gripper 15 of the impression cylinder 12. Thus, each of the sheets of paper is moved to the side guide to properly position the paper sheets for registration with the impression cylinder 12. As indicated earlier, the rotation of the impression cylinder 12, the drive roller 32 for driving the endless belt 13, and the vacuum wheel 18 are all rotated in fixed relationship to each other through gears and notched timing belts and pulleys. FIG. 5 is a schematic representation of the gear and timing pulley arrangement illustrating the interconnection between the impression cylinder 12, the feed rolls 14, the drive roller 32 for the endless belt 13 and the vacuum wheel 18. It can be seen in FIG. 5 that the impression cylinder 12 has a driven gear 21 that itself drives a feed roller gear 22 via an intermediate idler gear 24. Gear 21 has 108 teeth and 6.75" pitch diameter, intermediate gear 24 has 23 teeth, and feed roller gear 22 has 18 teeth. These three gears all exist in the current offset duplicators. Gear 22 drives shaft 23 to which is coupled the lower feed gear 19 of feed roller assembly 14. Thus, the rotation of the lower feed gear 19 is related to the rotation of impression cylinder 12. The present invention adds gear 25 which has 60 teeth and is driven by gear 22. Mounted on the same shaft 26 as gear 25 is a pulley 28 which has 44 grooves in it. Pulley 28 transmits drive through grooved belt 29 to a grooved pulley 30 that has 22 grooves therein. The belt 29 has 85 grooves and is 15 millimeters wide with the teeth having a 5 millimeter pitch. Shaft 31 is driven by pulley 30 and it has a roller 32 mounted at one end and a pulley 34 at the other end. Roller 32 drives the transport belt 13 and pulley 34 drives through belt 35 pulley 39. Pulley 39 has 44 grooves and drives shaft 37 to which is coupled the vacuum wheel 18 which is 4.1" in diameter. As indicated, belts 29 and 35 are timing belts and the pulleys 28, 30, 34 and 39 over which they are trained are timing pulleys.

As indicated previously, the suction drum 18 has a vacuum chamber with a plurality of orifices, not shown but well known in the art, spanning a segment thereof. The vacuum valve 46 is operated by controls in the duplicator to apply vacuum to the suction drum 18 so that it picks up a sheet from paper stack 6 at a predetermined time. Valve 46 is slaved to the offset duplicator so that vacuum is applied to the suction drum 18 sheet and deliver it to the endless belt 13 on transport table 10 in synchronism with the operation of the feed rollers 14 to assure that the feed rollers 14 receive a sheet to push into the impression cylinder gripper 15 when the clamp 15 is in the proper position and ready to receive a sheet. Accordingly, the movement of a sheet of paper is continuously maintained once it leave the paper stack 6. The velocity of the sheet is controlled by the interrelationship of the gears and timing pulleys so that as it leaves the suction drum 18 and then the transport belt 13, the sheet speed is increased approximately 1-to-2% at each hand-off.

Thus, the impression cylinder 15 rotation ratio to the rotation of transport belt drive roller 32 being driven by drive shaft 31 is equal to $108/60 \times 44/22 = 18/5 = 3.6$. Thus, for every rotation of impression cylinder 12, the endless transport belt drive roller 32 will rotate 3.6 times. With the diameter of roller 32 being 1.875 inches, the velocity of the endless transport belt 13 is fixed in relation to the rotation of the impression cylinder 12. The relationship of the impression cylinder 12 rotation to the vacuum wheel 18 rotation $= 108/60 \times 44/22 \times 20/44 = 18/11$. Thus, for each revolution or 360° rotation of impression cylinder 12, the vacuum wheel 18 moves 18/11 rotations. Thus, as stated earlier, the rotation of impression cylinder 12, feed rolls 14, velocity of the endless transport belt 13 and the rotation of the vacuum wheel 18 are all related. The point at which solenoid valve 46 opens and closes can be changed to apply a vacuum to the suction drum 18. This will cause the paper sheets from stack 6 to be lifted from the stack earlier or later than a given point in time. That will cause a change in position of the paper on the endless transport tape 13 and thus adjust the position of the paper with respect to the gripper 15 of the impression cylinder 12. It is apparent that more than one sensor 38 (shown in FIG. 4) can be placed along the length of endless transport belt 13 to assure precise transfer of the paper sheet to the transport belt 19 from the paper stack or pile 6 by the vacuum wheel 18.

An incremental encoder 60 is coupled to the shaft 62 that drives impression cylinder 12. This encoder may be of any well-known type that may be used to generate incremental signals indicating the instantaneous angular position of impression cylinder 12 with respect to a given index point. The microcomputer 42 may be overriden by the operator of the press to create a larger or smaller paper buckle on demand for special papers and applications. The operator simply changes the settings on a control panel (not shown), thus advancing or retarding, as desired, the timing of the opening of the vacuum valve 46 which in turn changes the position of the paper deposited on the endless transport belt 13.

Figure 6:
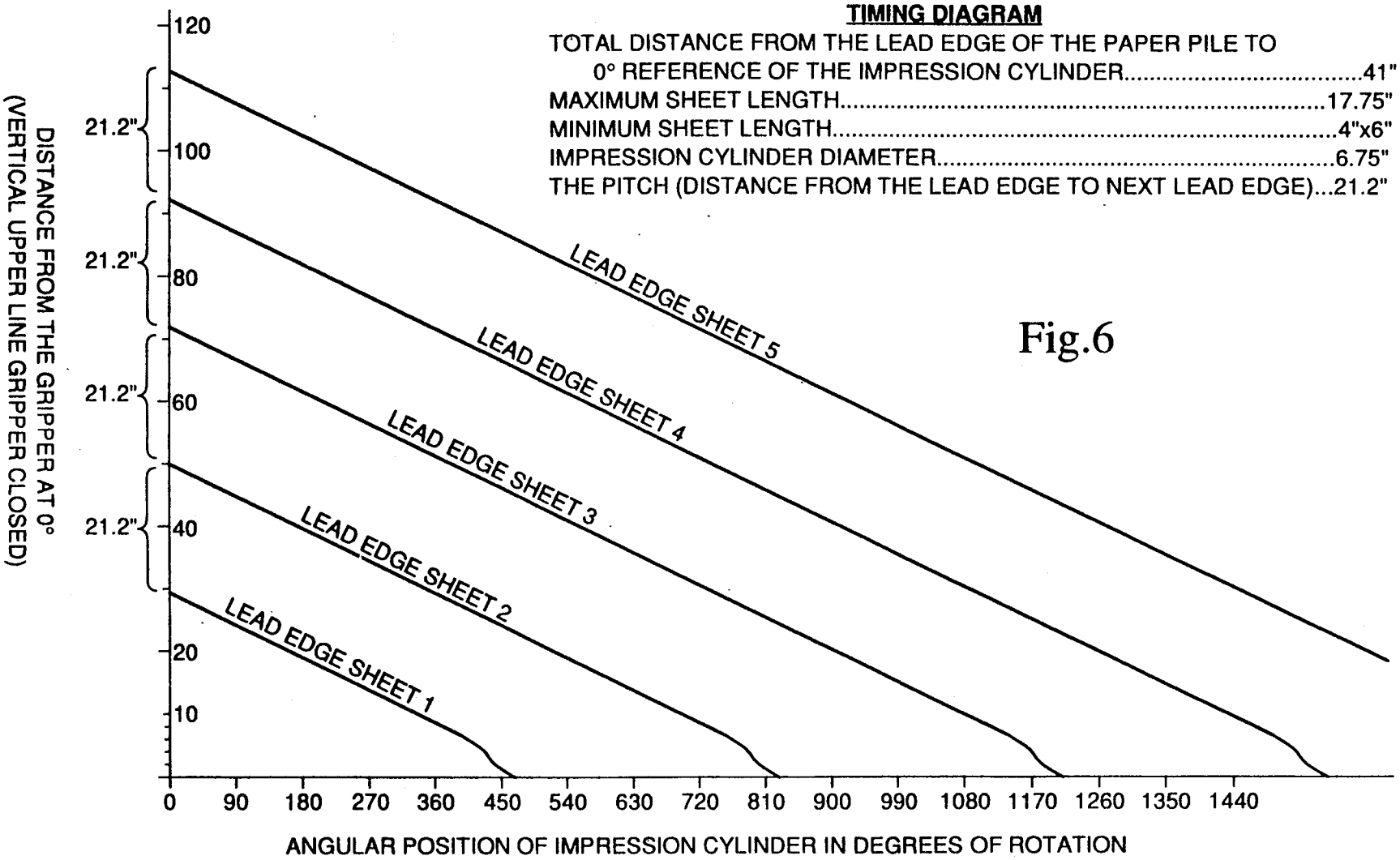
FIG. 6 is a graph of a timing diagram illustrating the distance from the lead edge of a sheet of paper to the impression cylinder grippers plotted against the angular position of the impression cylinder in degrees with respect to 0° reference.

Referring to FIG. 6, the ordinate of the plot represents the distance between the lead edge of a sheet on the paper stack or pile and the above identified lead edge position of a sheet ready to enter the gripper fingers 15 of the impression cylinder 12. Along the abscissa the angular position of the impression cylinder 12 with respect to the 0 reference point is given. Referring first to the plot in FIG. 6 labeled "Lead Edge Sheet 1", the lead edge of the first sheet of paper is 30 inches from the gripper fingers 15 when the impression cylinder 12 is at the reference or 0° angular position. As the impression cylinder 12 rotates thereby changing its angular position so that a higher degree value represents it, a lead edge of the sheet comes closer to the gripper fingers 15. When the impression cylinder has rotated to an angular position of approximately 480° the lead edge of the paper arrives at the predetermined pick-up position. After the lead edge of the first sheet has advanced 21.2 inches then the next sheet is peeled off the stack thereby resulting in the lead edge of the second sheet advancing toward the impression cylinder gripper fingers 15. The distance between the respective lead edges of sequentially fed sheets is 21.2 inches because that is the circumferential dimension of the particular impression cylinder 12 that is used in the offset machine example herein. If the circumferential dimension changes then the distance between the respective lead edges of the sheets would also change.

The length of the feed table 10 determines the total distance from the lead edge of the pile to the above mentioned "ready-to-enter-the-gripper-fingers" position, assuming that at such point in time the impression cylinder 12 is in angular position 0°, i.e. the reference point. In the preferred embodiment that distance is equal to 41 inches. If the table 10 is longer, then the plot labeled "Lead Edge Sheet 1" intersects the ordinate of the timing diagram of FIG. 6 at a value greater than the 30 inches shown. However, the slope remains the same for the respective plots representing the progressive advancement of the lead edges of each sheet as the values representing the angular position of the impression cylinder 12 increase.

In this regard, it should be noted that the slope changes as the lead edge of the paper enters the forwarding rollers and, at such point, the roller begins to accelerate the paper to a speed slightly greater than the peripheral speed of the impression cylinder in order to achieve buckling of the paper. This buckling of the paper enables proper registry of the lead edge into the gripper as well as minimizing lead edge damage.

Figure 7:
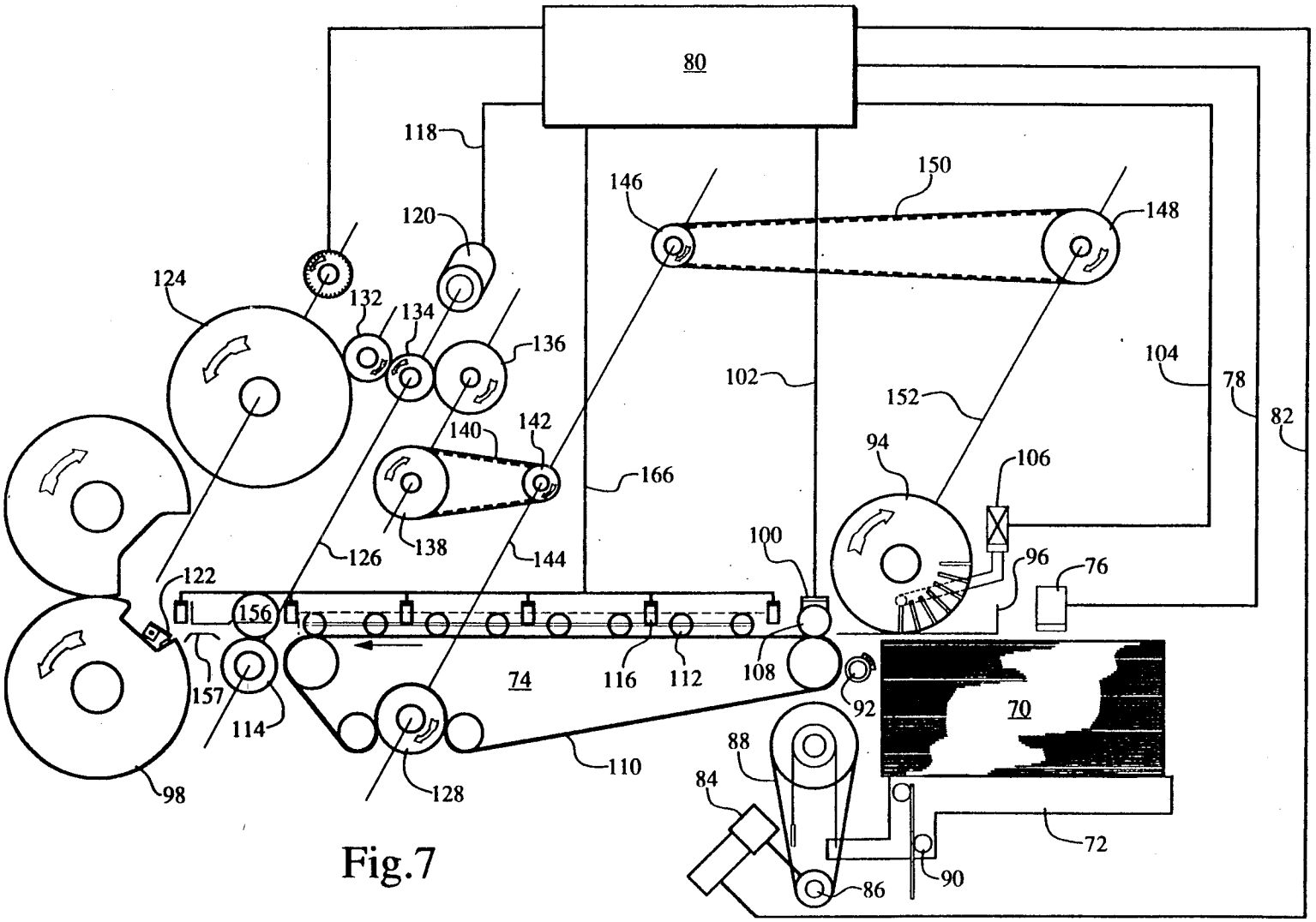
FIG. 7 is a conceptual side view of an offset duplicating machine illustrating an alternative embodiment of the printing machines of the present invention utilizing a servodrive mechanism for synchronized delivery of individual paper sheets from the paper stack to the stops of the impression cylinder gripper.

In the offset sheet-fed press/duplicator illustrated in FIG. 7, sheets of paper are individually supplied from a paper pile 70 supported by a table 72. The table 72 has two speeds (i.e., normal operating and quick up and down) for paper change over. A capacitive contactless sensor (not shown) is used to monitor the proper paper pile height. As the paper is infed to a transport or conveyor assembly 74 and the paper pile 70 is depleted, the change in the bulk of paper will be sensed by a paper sensor 76 and a signal will be generated via line 78 to a microprocessor 80. The microprocessor 80 via line 82 controls a pile table motor 84 to increment the table 72 up according to the paper used stock and to maintain the same level for paper infeeding. The table drive motor 84 has a worm gear head reducer to prevent the table 72 from being back driven by the weight of the paper and is connected to the lower sprocket 86 of a chain lift mechanism 88. The table 72 is guided by guide and bearing arrangements 90.

An air blower tube 92 connected to a pump (not shown) provides constant air blast necessary to separate the top four to six sheets of paper on the paper pile 70 and blow them up to a vacuum suction drum 94 with smoother plate 96. The vacuum suction drum 94 is a full size drum having the same radial size as impression cylinder 98. The suction drum 94 has a sector with orifices connected to the vacuum through the vacuum chamber. The suction drum 94 is driven in a 1 to 1 ratio with the impression cylinder 98 in order to achieve the same repetitive sheet pick up from the pile 70. The vacuum applied to the suction drum 94 pulls the top sheet of paper to the drum 94 and carries it to the transport or conveyor assembly 74. A double sheet sensor 100 is used to sense if more than one sheet of paper is being picked up by the suction drum 94. If so, a signal is generated on line 102 to the microprocessor 80 which generates a return signal on line 104 to stop the vacuum pick up by controlling the vacuum solenoid valve 106 and thus stopping the feeding. Thereby, the double sheet will be stopped at the caliper 108 of the double sheet sensor 100.

As illustrated in FIG. 7, the transport or conveyor assembly 74 has a single biased transport belt 110 that runs under a series of spherical or ball hold downs 112 to transport the sheet of paper deposited thereon by the vacuum suction drum 94 to the lower infeed roller assembly 114. A paper side guide 116, shown in dashed lines, serves the purpose of aligning the sheets of paper as the transport belt 110 drives the sheets forward toward the lower feed roller assembly 114. Accordingly, at the time a sheet of paper arrives at the nip of the feed roller assembly 114, it is completely aligned along the side. An array of paper sensors 116 is used to monitor the press speed and to generate an error signal on line 118 which is coupled to a servodrive motor 120. Thus, if an error signal occurs on line 118, the servodrive motor 120 will change its speed thereby changing the speed of the lower infeed roller assembly 114 which, in turn, causes the sheet of paper to arrive at the proper time with the proper buckle at the impression cylinder gripper 122. The operator of the press can override the microprocessor 80 by setting more or less gain of the servodrive system to create larger or smaller paper buckle on demand by settings on the control panel for special papers and applications.

In regard to the gearing and timing pulley arrangement illustrated in FIG. 7, the impression cylinder 98 has a gear 124 that drives the shaft 126 of a roller 128 of endless belt 130 via intermediate idler gears 132 and 134 and fixed gear 136 which is interconnected with timing pulley 138 in a manner such that pulley 138 transmits the drive through timing belt 140 to timing pulley 142. Shaft 144 is driven by the pulley 142 and drives the roller 128 of the conveyor belt 110. Timing pulley 146 drives pulley 148 via timing belt 150 fixed to the shaft 152 to which vacuum drum 94 is coupled.

Figure 8:
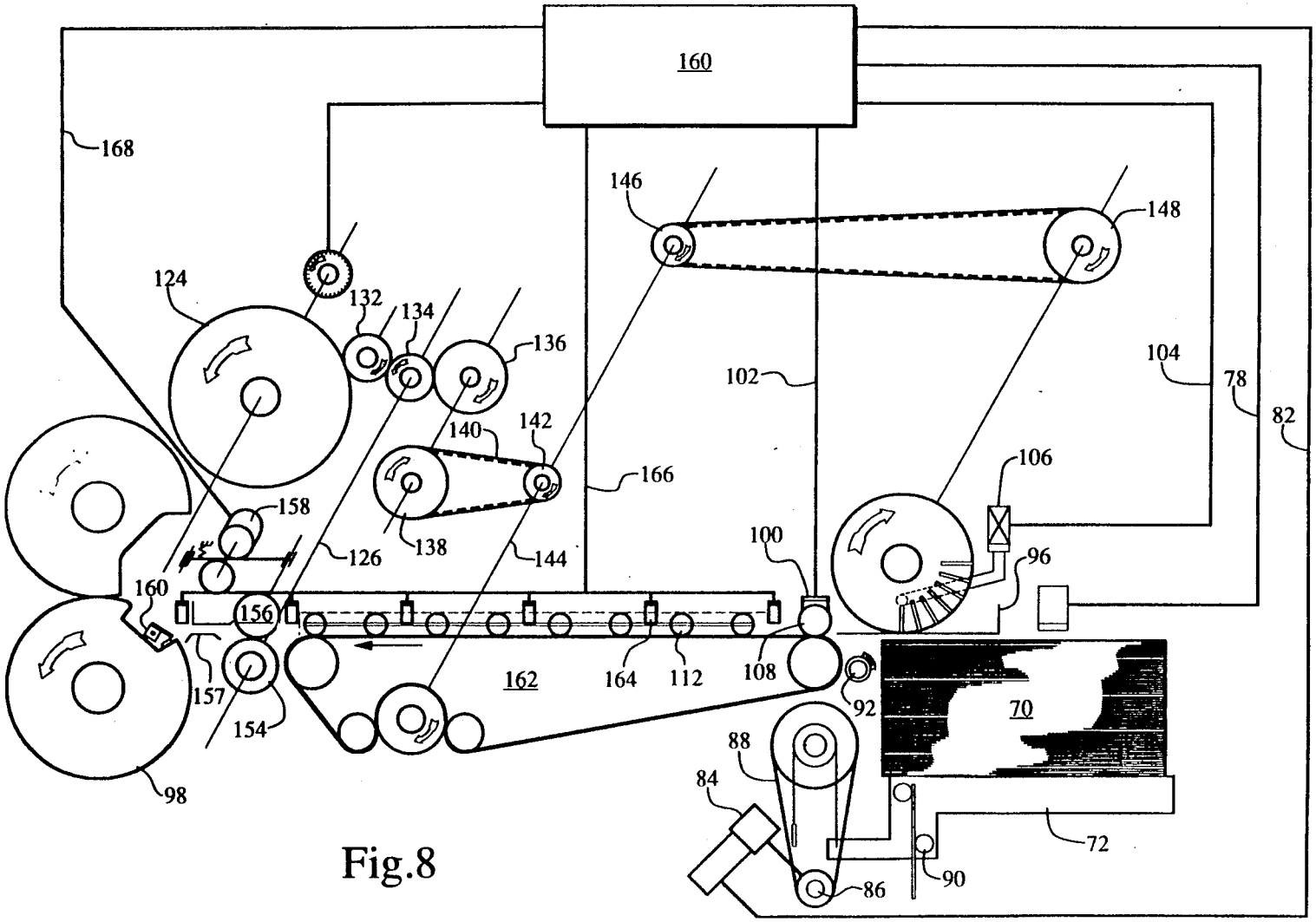
FIG. 8 is a conceptual side view of an offset duplicating machine illustrating another embodiment of the printing machines of the present invention utilizing a stepper motor apparatus for synchronized delivery of individual paper sheets from the paper stack to the stops of the impression cylinder gripper.

FIG. 8 illustrates another embodiment of an offset duplicating machine in accordance with this invention. In this embodiment, the lower feed roller assembly 154 is hard gear driven by the press. The upper feed roller assembly 156 is spring loaded toward the lower rollers 154 in order to feed the paper through a paper guide 157 into the impression cylinder grippers 160 with the proper buckle, then the upper feed rollers 156 are lifted to free the paper. In a conventional duplicator, the lifting and lowering of the upper feed rollers 156 normally is done by fixed cam arrangements. In the construction herein, the lifting and lowering of the upper feed assembly 156 is accomplished by a special stepper motor 158 controlled by a microprocessor 160. Thus, under normal operating conditions, the lifting and lowering of the upper roller 156 is performed by the stepper motor 158 in the same manner as if it were cam driven. However, if for any reason the sheet of paper arrives at conveyor table 162 earlier than required, an array of paper pass sensors 164 create a signal via line 166 to the microprocessor 160 which controls the stepper motor 158 via line 168 and adjusts the line of engagement of the upper forwarding rollers 156 so that they are lifted earlier and the proper amount of buckle of the sheet will be achieved. Furthermore, if the sheet of paper arrives onto conveyor table 162 later than required, then the microprocessor 160 changes the time period during which the stepper motor 158 lowers the upper roller assembly 156 and keeps it engaged longer to compensate for the late arrival and, accordingly, creates the right amount of paper buckle in the paper sheet.

Thus, there has been disclosed novel printing machines for copying indicia from a master document to paper sheets that consists of paper feeding means and registration means that are so interrelated that the paper moves in a nonstop manner from the paper stack to the endless belt to the impression cylinder. The sheets of paper are registered to the side paper guide by means of a skewed or biased belt using hold down balls and the side paper guide forwards the sheets of paper into the grippers of the impression cylinder for front registration and subsequent printing. The electronically controlled paper feeding and timing device consists of a contactless paper sensor located in close proximity to the gripper of the impression cylinder and an electronically controlled vacuum solenoid valve coupled to the suction drum. When paper arrives under the paper sensor location, the signal from the paper sensor is electronically processed and the required correction is made to time the vacuum solenoid valve of the suction drum in such a way that the paper sheets are deposited onto the endless belt in the right position to give the proper amount of buckle at the gripper of the impression cylinder in order to achieve good lead edge registration.

The foregoing specification describes only the embodiments of the invention shown and/or described. Other embodiments may be articulated as well. The terms and expressions used, therefore, serve only to describe the invention by example and not to limit the invention. It is expected that others will perceive differences which, while different from the foregoing, do not depart from the scope of the invention herein described and claimed. In particular, any of the specific constructional elements described may be replaced by any other known element having equivalent function.

We claim:

1. A printing machine for printing indicia on paper sheets which are supplied from a stack comprising:

a cylinder for receiving the paper sheets;

an endless belt for supplying the paper sheets to the cylinder;

vacuum means for removing paper sheets from the stack and delivering the sheets to the endless belt consecutively; and means for controlling the vacuum means in synchronization with the rotation of the cylinder such that a sheet of paper is delivered by the endless belt to the cylinder at the proper time for correctly printing the paper sheets without stopping and starting the paper between the stack and the cylinder.

2. A printing machine as in claim 1 further comprising a guide on one side of the endless belt to guide the paper sheets as they move along with the endless belt.

3. A printing machine as in claim 2 wherein the endless belt is skewed in order to force the paper sheets toward the side guide.

4. A printing machine as in claim 3 further including a hold-down means comprising:

an elongated carrier extending above the endless belt aligned in the direction of movement of the belt and toward the side guide; and a plurality of spherical means mounted in the carrier for making contact with each sheet of paper so as to hold-down each of the sheets of paper as the paper is forced toward the side guide by the skewed endless belt whereby the paper sheets are properly positioned for registration with the cylinder.

5. A printing machine as in claim 1 wherein the means for controlling the vacuum means comprises:

a vacuum paper pickup in proximity to the stack of paper sheets;

a control valve coupled to the vacuum paper pickup for starting and stopping the vacuum supplied to the vacuum paper pickup; and timing means coupled to the vacuum control valve for varying the time the vacuum is started and stopped so as to adjust the time at which a paper sheet is delivered to the endless belt by the vacuum pickup.

6. A printing machine as in claim 5 wherein the timing means comprises:

a paper receiving gripper on the cylinder for receiving and holding a sheet of paper that is to be imprinted with indicia;

gripper position indicator means coupled to the cylinder for generating a timing signal indicating the instantaneous rotatable position of the paper receiving gripper;

sensors associated with the movement of the paper sheet from the vacuum paper pickup to the cylinder gripper for generating signals representing the instantaneous position of a sheet of paper with respect to the instantaneous rotatable position of the cylinder gripper;

means coupled to the sensors and the cylinder gripper position indicator means for generating an error signal representing a deviation of the paper sheet from its proper position with respect to an instantaneous cylinder gripper position; and means coupling the error signal to the paper pickup vacuum control valve to change the time at which the valve is opened and closed so as to change the time at which the vacuum paper pickup places the sheet of paper on the endless belt so as to deliver the sheet of paper to the cylinder gripper at the desired time.

7. A printing machine as in claim 6 wherein the vacuum paper pickup comprises:

a rotatable drum in proximity with the stack of sheets and having a predetermined number of orifices over a peripheral surface area; and means coupling the vacuum control valve to the interior of the rotatable drum so as to selectively apply and remove a suction to the drum interior and enable a single sheet of paper to be removed from the stack and placed on the endless belt by the rotatable drum.

8. A printing machine as in claim 7 further comprising means for manually changing the timing of the pickup of the paper sheet to cause an adjustment in the paper sheet arrival time at the cylinder gripper.

9. A printing machine as in claim 8 further comprising means associated with the paper stack for providing an air blast of an amount sufficient to separate at least the top sheet of paper in the stock from the remainder of the sheets to enable one sheet to be transferred from the paper stack to the endless belt.

10. A printing machine as in claim 6 wherein the vacuum paper pickup comprises:

a plurality of vacuum sucker feet in proximity with the stack of sheets for picking up a paper sheet from the paper stack and depositing the sheet on the endless belt; and means coupling a vacuum control valve to each of the vacuum sucker feet so as to selectively apply and remove a suction to the feet and enable a single sheet of paper to be removed from the stack and placed on the endless belt by the feet.

11. A printing machine for printing indicia on paper sheets which are supplied from a stack comprising:

an impression cylinder having a gripper for receiving the paper sheets;

a transport belt for supplying paper sheets to the gripper of the impression cylinder;

vacuum means for removing paper sheets from the stack and delivering the sheets to the transport belt;

first means connected to the impression cylinder for rotating the impression cylinder at a given rate;

second means coupled to said first means and to said transport belt for moving the transport belt at a velocity related to the rotation of the impression cylinder; and third means coupled to the second means and the vacuum means for operating the vacuum means at a rate related to the transport rate such that movement of the paper sheet between the vacuum means and the impression cylinder is continuous and nonstopping.

12. A printing machine as in claim 11 further including:

upper and lower rollers for feeding the paper sheets from the transport belt to the impression cylinder;

fourth means coupled to and driving the upper and lower feed rollers; and fifth means coupling the first means to said fourth means for driving the upper and lower feed rollers.

13. A printing machine as in claim 12 wherein the second means comprises:

drive means for moving the transport belt;

a drive shaft coupled to the transport belt drive means for providing power thereto; and sixth means coupling the fourth means to the drive shaft for driving the transport belt at a velocity related to the rotation of the impression cylinder.

14. A printing machine as in claim 13 wherein the sixth means comprises:

an idler shaft;

a first drive wheel mounted on the idler shaft and coupled to the fourth means for receiving power;

a second drive wheel rigidly attached to the idler shaft; and a third drive wheel mounted on the drive shaft and coupled to the second drive wheel such that rotation of the impression cylinder rotates the transport belt drive shaft to move the belt at a velocity related to the impression cylinder rotation.

15. A printing machine as in claim 11 further comprising:

means coupled to the impression cylinder for detecting the instantaneous angular position of the rotating impression cylinder;

means associated with the transport belt for determining the instantaneous position of the paper sheet on the transport belt; and a microprocessor coupled to the detecting means, the paper positioning means and the vacuum means to cause the vacuum means to deliver the paper sheets to the transport belt such that the sheets are received by the impression cylinder at the proper time to enable proper registration of the paper sheets with the impression cylinder without stopping and starting the paper sheets between the vacuum means and the impression cylinder.

16. A printing machine for printing indicia on paper sheets which are supplied from a stack comprising:

a combined impression cylinder/blanket cylinder having a gripper for receiving the paper sheets;

a transport belt for supplying paper sheets to the gripper of the combined impression cylinder/blanket cylinder;

vacuum means for removing paper sheets from the stack and delivering the sheets to the transport belt;

first means connected to the combined impression cylinder/blanket cylinder for rotating the combined impression cylinder/blanket cylinder at a give rate;

second means coupled to said first means and to said transport belt for moving the transport belt at a velocity related to the rotation of the combined impression cylinder/blanket cylinder; and third means coupled to the second means and the vacuum means for operating the vacuum means at a rate related to the transport belt velocity and the combined impression cylinder/blanket cylinder rotation rate such that movement of the paper sheet between the vacuum means and the combined impression cylinder/blanket cylinder is continuous and nonstopping.

17. A printing machine for printing indicia on paper sheets which are supplied from a stack comprising:

a transport cylinder having a gripper for receiving paper sheets;

a transport belt for supplying paper sheets to the gripper of the transport cylinder;

vacuum means for removing paper sheets form the stack and delivering the sheets to the transport belt;

first means connected to the transport cylinder for rotating the transport cylinder at a given rate;

second means coupled to said first means and to said transport belt for moving the transport belt at a velocity related to the rotation of the transport cylinder; and third means coupled to the second means and the vacuum means for operating the vacuum means at a rate related to the transport belt velocity and the transport cylinder rotation rate such that movement of the paper sheet between the vacuum means and the transport cylinder is continuous and nonstopping.

18. A method of duplicating indicia on individual paper sheets comprising the steps of:

receiving individual sheets of paper in a cylinder gripper to transport said paper for printing of indicia on the sheet of paper;

removing the individual paper sheets from a stack of paper sheets;

continuously maintaining movement of each paper sheet between the stock of paper sheets and the cylinder gripper without stopping and starting thereby increasing the number of sheets that can be printed in a give time;

timing the continuous movement of the paper sheets between the paper stack and the cylinder gripper; and adjusting the time at which each sheet of paper commences the continuous movement to the cylinder gripper such that each paper sheet will arrive at the cylinder gripper at the proper time.

19. A method as in claim 18 wherein the step of adjusting the time at which sheet of paper commences movement comprises the steps of:

providing an endless belt to move the paper from the paper stack to the cylinder gripper;

using a suction device to move each sheet of paper from the paper stack to the belt;

detecting the position of each paper sheet on the belt; and adjusting the suction device to vary the time at which each sheet of paper is removed from the stack and placed on the endless belt so as to vary the time each sheet of paper arrives at the cylinder gripper.

20. A method of duplicating the indicia on a master document on individual paper sheets comprising the steps of:

receiving individual sheets of paper in an impression cylinder gripper, rotation of said impression cylinder causing indicia to be printed on the sheet of paper held in said gripper;

removing the individual sheets of paper from a stack of paper sheets with a suction device;

consecutively moving the individual sheets toward the impression cylinder gripper;

continuously maintaining movement of each paper sheet between the stack of paper sheets and the cylinder gripper without stopping and starting thereby increasing the number of sheets that can be printed in a give time; and regulating the suction device to time the commencement of movement of each individual sheet of paper toward the impression cylinder gripper such that each sheet of paper arrives at the impression cylinder gripper at the time proper time without stopping and starting.

21. A method as in claim 20 wherein the step of regulating the suction device comprises the steps of:

generating a first signal representing the instantaneous rotated position of the impression cylinder gripper;

generating a second signal representing the instantaneous position of each paper sheet moving towards the impression cylinder;

generating an error correction signal if the first and second signals indicate that a sheet position is such that it will not arrive at the impression cylinder gripper at the proper time; and controlling the vacuum to the suction device to delay or advance the time of sheet pickup thereby controlling the instantaneous position of each sheet of paper so that it arrives at the impression cylinder gripper at the proper time without stopping and starting.

22. A method as in claim 20 the step of generating a correction error signal further comprises the steps of:

coupling the first signal representing the impression cylinder gripper position to a microprocessor and the second signal representing the paper position and generating said error correction signal if the instantaneous paper position is such that it will not arrive at the impression cylinder gripper at the proper time; and using the error correction signal to cause a delay or advance in the paper sheet pickup so as to adjust the instantaneous sheet position with respect to the impression cylinder gripper position to cause arrival of each paper sheet at the impression cylinder gripper at the proper time without stopping and starting.

23. A method as in claim 22 further including the step of using the error correction signal to turn the vacuum control valve on and off at predetermined times to vary the paper pick-up time.

24. A method of duplicating the indicia on a master document on individual paper sheets comprising the steps of:

receiving individual sheets of paper in an impression cylinder gripper, rotation of said impression cylinder causing indicia to be printed on the sheet of paper held in said gripper;

removing the individual sheets of paper from a stack of paper sheets;

consecutively moving the individual sheets toward the impression cylinder gripper;

continuously maintaining movement of each paper sheet between the stack of paper sheets and the cylinder gripper without stopping and starting thereby increasing the number of sheets that can be printed in a give time; and regulating the speed of movement of each paper sheet between the stack of paper sheets and the cylinder gripper to compensate for any mispositioning or buckling of said paper sheet as said paper sheet is received in said impression cylinder gripper.

25. A method as in claim 24 wherein the step of regulating the speed of movement of each paper sheet comprises the step of:

varying the speed of a transport belt interposed between said stack and said cylinder gripper for moving said paper sheets from said stack to said cylinder gripper.

26. A method as in claim 24 wherein the step of regulating the speed of movement of each paper sheet comprises the step of:

varying the speed of forwarding rollers interposed between said stack and said cylinder gripper for moving said paper sheets from said stack to said cylinder gripper.

* * * * *

UNITED STATES PATENT AND TRADEMARK OFFICE

CERTIFICATE OF CORRECTION

PATENT NO. : 5,103,733

DATED : April 14, 1992

INVENTOR(S) : Drapatsky et al.

It is certified that error appears in the above—identified patent and that said Letters Patent is hereby corrected as shown below:

Column 5, line 40, change "feed" to --fed--.

Column 7, line 4, change "leave" to --leaves--.

Column 7, lines 43 and 44, change "over-riden" to --over-ridden".

Column 12, line 22, change "transport rate" to --transport belt velocity and the impression cylinder rotation rate--.

Column 13, lines 31 and 32, change "receiving paper" to --receiving the paper--.

Column 13, line 34, change "form" to --from--.

Column 13, line 58, change "stock" to --stack--.

Column 13, line 61, change "give" to --given--.

Column 14, line 29, change "give" to --given--.

Column 14, line 34, change "the timer proper" to --the proper--.

Column 14, line 55, change "20 the" to --20 wherein the--.

Column 16, line 2, change "give" to --given--.

Signed and Sealed this

Twenty-eighth Day of September, 1993

Bruce Lehman

*Attest:*

BRUCE LEHMAN

*Attesting Officer*

*Commissioner of Patents and Trademarks*